US006679815B2

(12) United States Patent
Vittone et al.

(10) Patent No.: US 6,679,815 B2
(45) Date of Patent: Jan. 20, 2004

(54) WEIGHT-SUPPORTING APPARATUS FOR USE DURING A LIFTING EXERCISE

(76) Inventors: Larry W. Vittone, Rte. 1, Box 55, Hurley, WI (US) 54534; Suzanne R. Vittone, Rte. 1, Box 55, Hurley, WI (US) 54534

( * ) Notice: Subject to any disclaimer, the term of this patent is extended or adjusted under 35 U.S.C. 154(b) by 310 days.

(21) Appl. No.: 09/817,565

(22) Filed: Mar. 26, 2001

(65) Prior Publication Data

US 2002/0137603 A1 Sep. 26, 2002

(51) Int. Cl.[7] ..... A63B 21/06

(52) U.S. Cl. ..... 482/78; 482/93; 482/98; 482/106

(58) Field of Search ..... 482/66, 78, 93, 482/94, 97, 98, 104–108, 110, 148

(56) References Cited

U.S. PATENT DOCUMENTS 3,414,261 A * 12/1968 Huebner ..... 482/97
4,018,439 A * 4/1977 Kauk ..... 482/66
4,018,442 A * 4/1977 Galler ..... 482/106
4,749,188 A * 6/1988 Montgomery ..... 482/106
4,773,639 A * 9/1988 Graves ..... 482/66
5,679,105 A 10/1997 Vittone et al.
6,004,245 A * 12/1999 Boos ..... 482/93

FOREIGN PATENT DOCUMENTS

CH 683967 A5 * 6/1994

* cited by examiner

*Primary Examiner*—Nicholas D. Lucchesi
*Assistant Examiner*—Victor Hwang
(74) *Attorney, Agent, or Firm*—Michael E. McKee

(57) ABSTRACT

An exercise apparatus utilizes a weight-laden frame which is grasped by the hands of a user during an exercise routine for lifting the frame from the floor during a lift phase of the exercise routine and for subsequently returning the frame to the floor during a lowering phase of the routine. To enhance the strength gains of the user, the user walks while holding the apparatus in spaced relationship with the floor following the lift phase of the routine. The frame of the apparatus is sized so that walking movements of the user are unobstructed by the frame and so that if the apparatus is dropped while the user walks while holding the apparatus, no part of the apparatus strikes the legs or feet of the user.

13 Claims, 7 Drawing Sheets

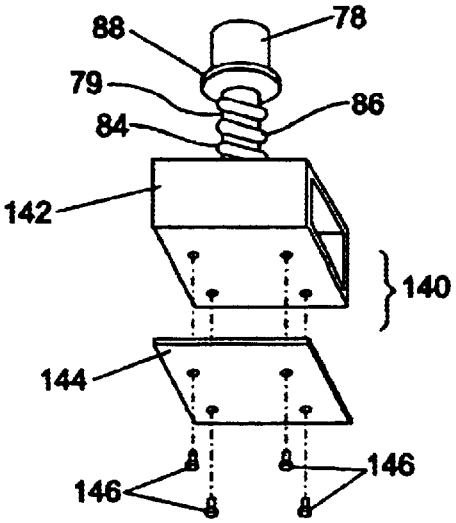
FIG. 9
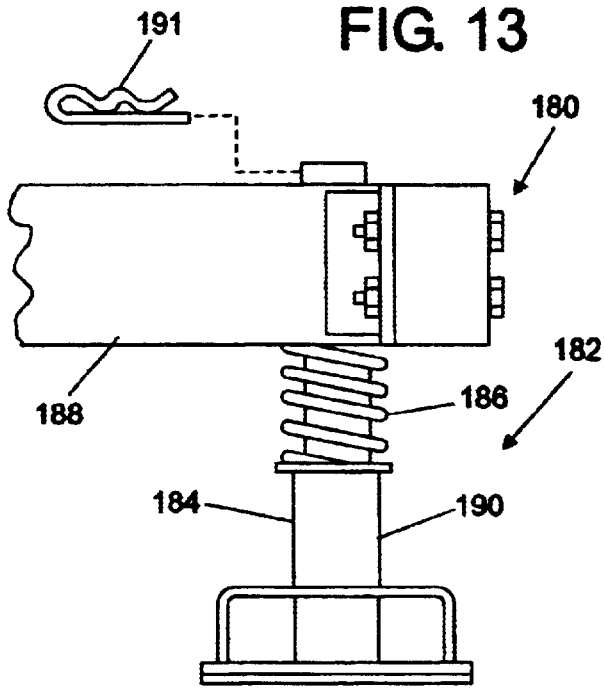
FIG. 13
FIG. 12
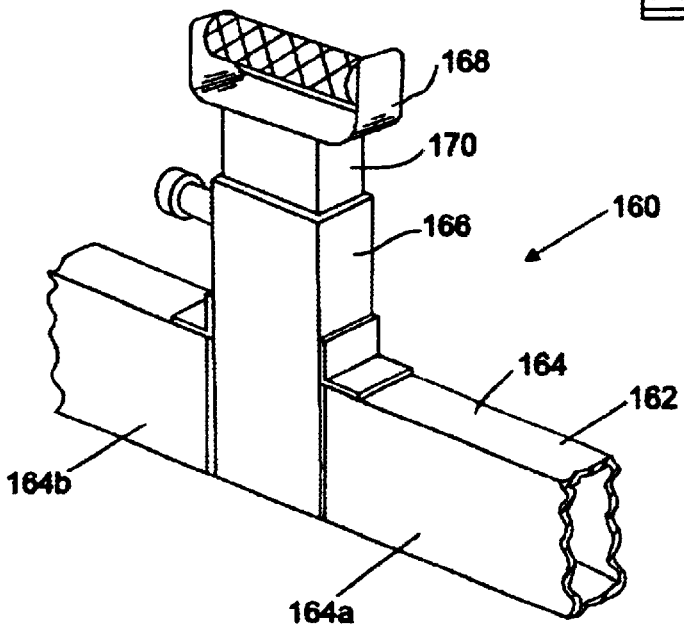

WEIGHT-SUPPORTING APPARATUS FOR USE DURING A LIFTING EXERCISE

BACKGROUND OF THE INVENTION

This invention relates generally to exercise equipment and relates, more specifically, to means for enhancing the strength and physical conditioning of an individual through the performance of an exercise routine involving the lifting of weights.

A common strengthening exercise routine requires that an individual squats or bends over from a standing position, grabs onto a barbell or similar weight-laden apparatus resting on the floor or underlying support surface and then resumes his standing position while lifting the barbell from the floor. This lifting phase of the routine is followed by a lowering phase wherein the barbell is lowered to the floor as the individual squats or bends over from the standing position. A variation of the same exercise routine calls for the individual to hold the barbell off of the floor for a predetermined (e.g. lengthy) period of time before it is lowered to the floor.

It is an object of the present invention to provide a new and improved apparatus capable of being grasped and lifted from the floor by an individual during the performance of a strength-enhancing exercise routine wherein the movements required to be performed by the individual are comparable to those involved in the common barbell-lifting exercises described above and also permits the individual who performs the exercise to walk while holding the apparatus off of the floor.

Another object of the present invention is to provide such an apparatus which reduces the likelihood of injury to a user if the apparatus is inadvertently dropped or lowered to the floor as the user walks with the apparatus while holding the apparatus off of the floor.

Still another object of the present invention is to provide such an apparatus wherein the return of the apparatus to the floor from a raised position is cushioned.

Yet another object of the present invention is to provide such an apparatus to which weights can be readily added or removed.

A further object of the present invention is to provide such an apparatus having features which accommodate the adjustment of the apparatus to users of different height.

A still further object of the present invention is to provide such an apparatus which is uncomplicated in construction and relatively easy to use.

SUMMARY OF THE INVENTION

This invention resides in an apparatus for use during the performance of an exercise routine wherein the exercise routine includes a lift phase during which the user lifts the apparatus from the floor and a lowering phase during which the user returns the apparatus to the floor.

The apparatus includes a frame within which a user stands for the performance of an exercise routine and two hand grips with which the apparatus is lifted from the floor by the user to a raised condition during the lift phase of the exercise routine and is returned to the floor during the lowering phase of the exercise routine. The two hand grips are disposed on opposite sides of the user from one another as the user stands within the frame, and the frame is sized to permit the user to walk forwardly or rearwardly with the apparatus while the apparatus is held in its raised condition so that as the user holds the apparatus in its raised condition with the hand grips and takes forward or rearward steps which measure at least about three feet in length, the frame does not obstruct the walking movements of the user. Furthermore, the frame is shaped so that if the apparatus is dropped to the floor while the user is walking forwardly or rearwardly with the apparatus, no part of the user's feet or legs is struck by the apparatus frame.

BRIEF DESCRIPTION OF THE DRAWINGS

FIG. 9 is a perspective view of a portion of the FIG. 6 fragment, shown exploded.

FIG. 12 is a perspective view of one fragment of another embodiment of an apparatus within which features of the present invention are embodied.

FIG. 13 is a perspective view of a fragment of an alternative embodiment within which features of the present invention are embodied.

DETAILED DESCRIPTION OF ILLUSTRATIVE EMBODIMENTS

Figure 1:
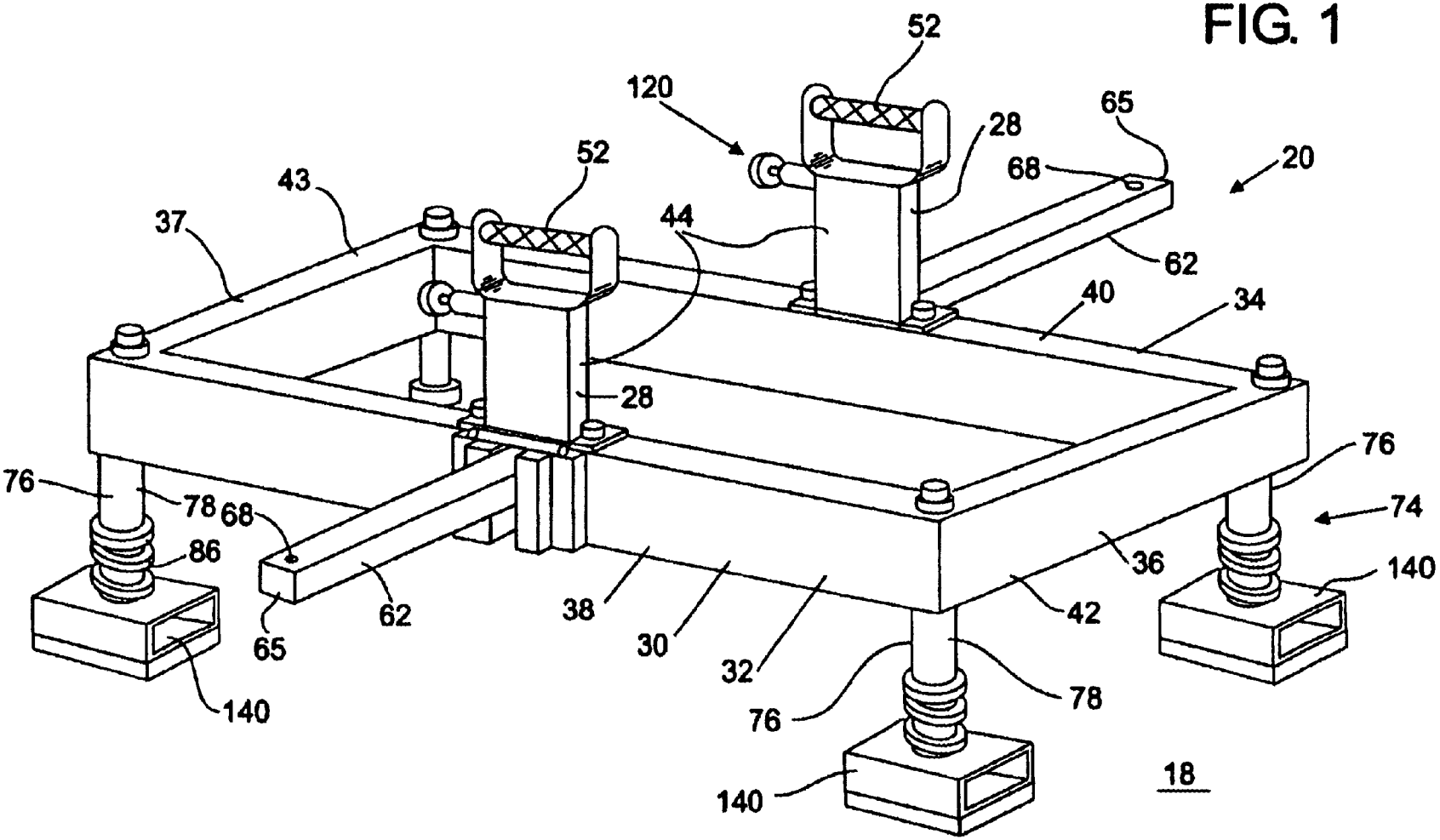
FIG. 1 is a perspective view of an embodiment of an apparatus within which features of the present invention are embodied.

Turning now to the drawings in greater detail, there is illustrated in FIG. 1 an embodiment, generally indicated 20, of an apparatus for use during a lifting exercise routine wherein an individual repeatedly lifts the apparatus 20 from the floor 18 from a squat position to a standing, or upright, position and returns, or lowers, the apparatus 20 to the floor 18 following each successive lift of the apparatus 20. As used herein, the term "floor" is intended to include the ground or some other suitable underlying support surface, as well as the floor of a room or building. At the outset of a lift, or lift phase, of such an exercise routine, the individual stands in a flexed position (e.g. simulating a shallow squat position) with his back erect while his knees are slightly bent, and during the lift phase of the routine, the individual stands upright from the flexed position so that his legs are moved to a substantially straight condition. As the individual subsequently returns the apparatus 20 to the floor (under the influence of gravity) during a lowering phase of the routine, his legs are permitted to bend under the weight of the apparatus to return the individual to the flexed position in preparation for a subsequent repetition of the exercise.

As will be apparent herein, the apparatus 20 is held by the hands of the user throughout the lift and lowering phases of the exercise routine and is designed to permit the user to walk forwardly and rearwardly while holding the apparatus 20 in a raised condition. Accordingly, it is a feature of the apparatus 20 that walking motions (in either forward or rearward directions) of the user are not impeded by the apparatus 20, and if the apparatus 20 is dropped from its raised condition while the apparatus is in its raised condition, no part of the apparatus 20 strikes the legs or feet of the user. Furthermore, the apparatus 20 is adapted to support barbell weights added thereto (to thereby adjust the amount of the total weight lifted and carried by the user) and accommodates the addition or removal of barbell weights from the apparatus 20 with relative ease.

Figure 2:
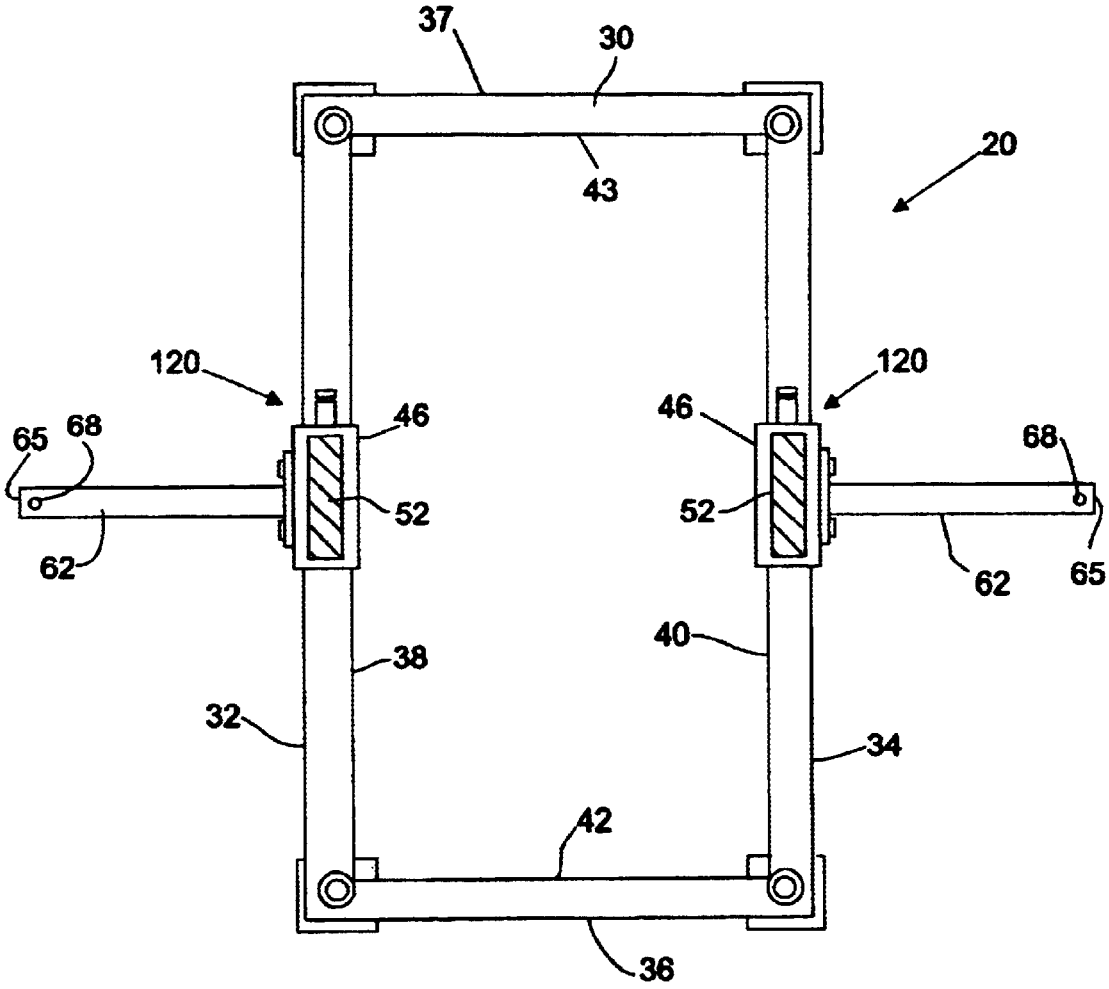
FIG. 2 is a plan view of the FIG. 1 apparatus, as seen from above in FIG. 1.

With reference to FIGS. 1 and 2, the apparatus 20 includes a frame 30 having two opposite side sections 32, 34 and opposite front and rear sections 36, 37, respectively. Each of the side and front and rear sections 32, 34, 36 and 37 include a beam 38, 40, 42 or 43, respectively, which is comprised, for example, of steel having a rectangular cross section, and the ends of the beams 38, 40, 42 and 43 are joined together, as with welds, to form a closed-loop rectangular-shaped arrangement (best seen in FIG. 2). For use of the apparatus 20, a user stands within the center of the frame 30 so that each of the side sections 32 or 34 is disposed to a corresponding side of the user and so that the front and rear sections are disposed forwardly and rearwardly of the user. Accordingly, the rectangular-shaped arrangement formed by the beams 38, 40, 42 and 43 of the frame 30 is sized to accommodate the user when standing therein. When used in describing the frame of the apparatus and in the interests of the present invention, the term "closed-looped" is intended to mean that the frame forms an endless loop (i.e. with no breaks) so that when a user stands within the frame, he is completely surrounded by the frame.

Each component of the frame 30 of the apparatus, as well as every other component of the apparatus 20, unless otherwise indicated, is constructed of steel to enhance the strength and rigidity of the apparatus 20 and to add a measure of weight to the frame 30. However, other suitable materials, such as suitable wood products and strong plastics, can be employed instead of steel.

Figure 4:
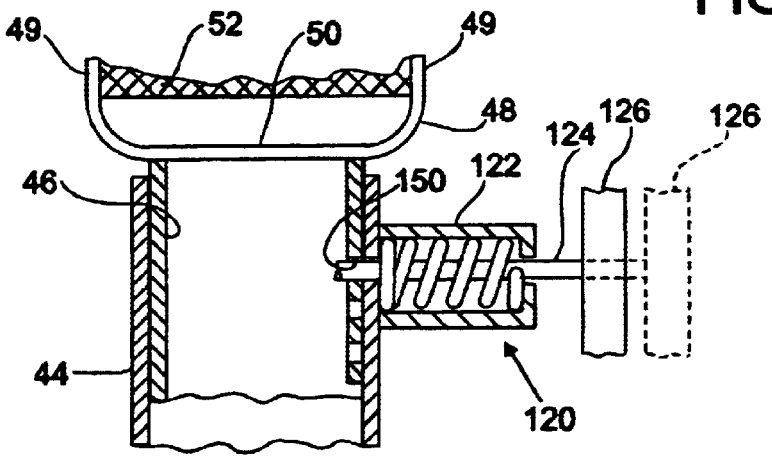
FIG. 4 is a cross-sectional view taken about along line 4—4 of FIG. 3.
Figure 3:
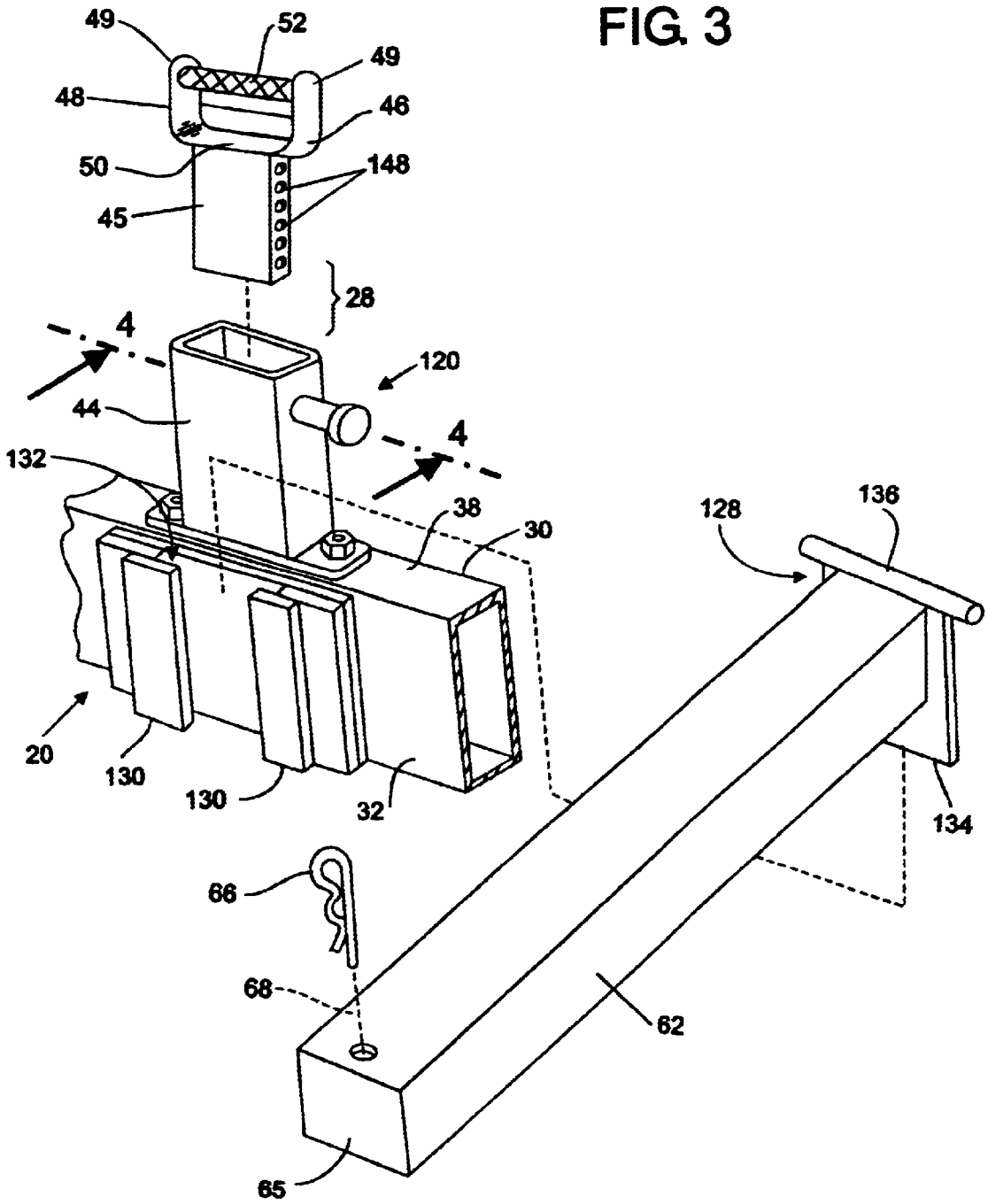
FIG. 3 is a perspective view of one fragment of the FIG. 1 apparatus, shown exploded.
Figure 5:
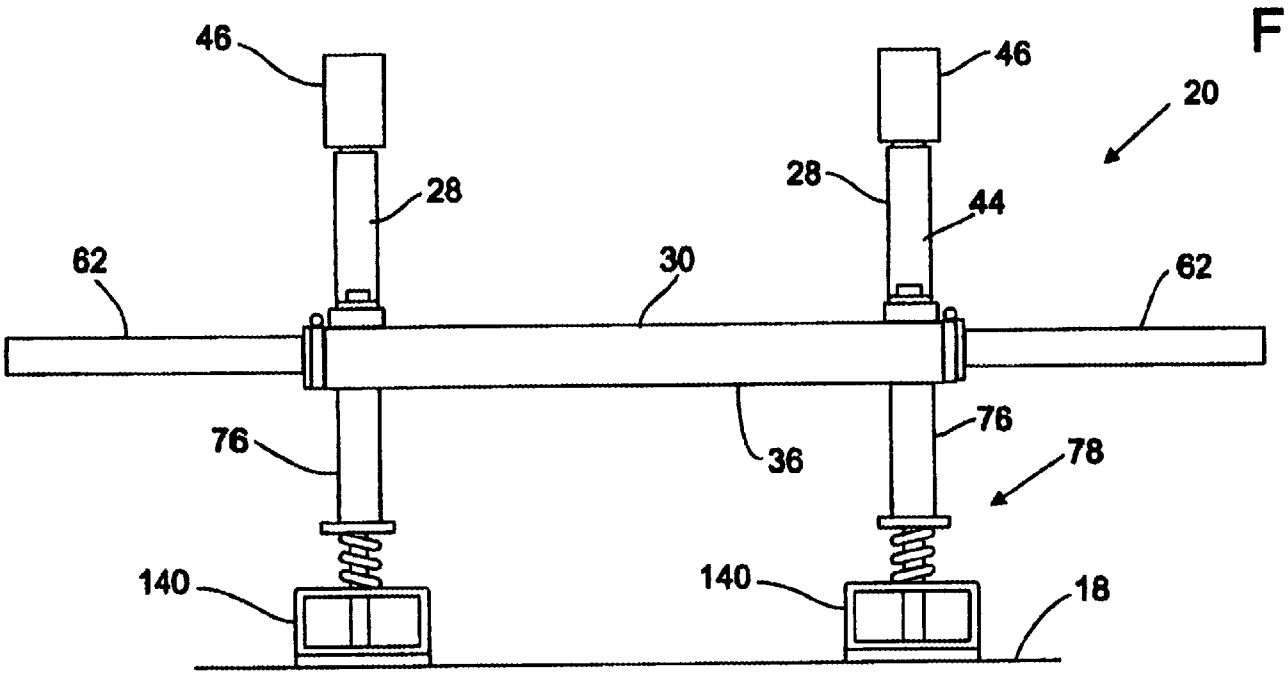
FIG. 5 is a front elevational view of the FIG. 1 apparatus as seen generally from the right in FIG. 1.

With respect to the FIGS. 3 and 4, there is associated with each side section 32 or 34 an upstanding assembly 28 including a vertically-oriented sleeve 44 joined at its lower end atop a corresponding beam 38 or 40 (at a location disposed about midway along the length of the beam 40) so as to extend upwardly therefrom and a post 45 which is slidably positioned within the sleeve 44 to accommodate vertical movement of the post 45 relative to the sleeve 44. Attached to the upper end of each post 45 is a handle assembly 46 including a U-shaped portion 48 having side sections 49 joined by a bridge section 50 which is, in turn, joined to the upper end of the post 45. In addition, each handle assembly 46 includes an elongated hand grip 52 joined to so as to extend between the side sections 49 of the U-shaped portion 48. To enhance the user's comfort when grasping the grips 52, each grip 52 is preferably wrapped with a relatively soft padding.

The position of each post 45 relative to its corresponding sleeve 44 can be adjusted with a pin assembly 120 associated with the handle assembly 46. In this connection and as best shown in FIG. 4, the sleeve 44 defines an opening 150 in one side thereof, and the pin assembly 120 includes a cylindrical member 122 which is joined to a side of the sleeve 44 about the defined opening 150. In addition, a spring-biased pin 124 having a movable knob 126 attached thereto is secured within the member 122 so that the end of the pin 124 opposite the knob 126 is received by the defined opening 150 in the sleeve 44 and is biased toward the center of the post 45. The post 45, in turn, includes a series of openings 148 (which can each accept an end of the pin 124) disposed vertically along its length, and each of these post openings can be aligned with the defined opening of the sleeve 44 by sliding the post 45 to alternative vertical positions along the length of the sleeve 44. Therefore, to adjust the position of the post 45 relative to the sleeve 44, the knob 126 of the pin 124 is pulled out of the post opening within which it is received, and then the post 45 is manually slid along the length of the sleeve 44 so that an alternative post opening is aligned with the defined sleeve opening, and then the knob 126 is released to permit the pin 124 to be accepted by the aligned openings of the sleeve 44 and post 45 to pin and thereby secure the post 45 in a fixed position along the length of the sleeve 44.

The aforedescribed handle assembly 46 and the capacity to secure the post 45 within the sleeve 44 at alternative positions therealong provides means accommodating an adjustment in the height, or distance as measured vertically, between the grips 52 and the underlying floor 18. Inasmuch as the height of potential users of the apparatus 20 (and thus the spaced distance between the hands of the users and the floor 18 when the users stand erect with hands at the side) can differ from one another by an appreciable amount, the capacity to shift the position of the grips 52 relative to the floor 18 permits the apparatus 20 to be adjusted to accommodate users of different heights. For safety considerations and in order to prevent a user from having to lift the apparatus 20 (and the amount of weight that may be added to the apparatus 20) from a large distance from the floor, it is preferred that during use of the apparatus 20, each grip 52 is positioned at a distance from the floor 18 which is at least about twenty inches.

It follows from the foregoing that within the depicted apparatus 20, the two hand grips 52 are rigidly connected to one another through the frame 30 so that the spaced distance between the hand grips 52 remains constant. With the hand grips 52 in a fixed relationship to one another, the grips 52 are not independent of one another and can be controlled, when lifted, with much more ease than is the case with gripped weights, such as dumbbells, which are independent of one another.

Also associated with each side section 32 or 34 is a weight-supporting bar 62 (FIGS. 1–3) which is joined at one of its ends to a corresponding side section 32 or 34 so as to extend laterally therefrom. The bar 62 is sized (in cross section) to accept the two-inch diameter openings of standard-size (e.g. olympic) barbell weights 64 (FIG. 10) directed over the free end, indicated 65 in FIGS. 1–3, of the bar 62, and a retainer pin 66 (FIG. 3) is releasably positionable through an opening 68 provided in the free end 65 to prevent the weights 64 from being removed from the bar 62 unless the pin 66 is removed from the opening 68.

Within the depicted apparatus 20, each bar 62 is releasably joined to its corresponding side section 32 or 34 with a bayonet-type arrangement, indicated 128 in FIG. 3. More specifically and as best shown in FIG. 3, a pair of track members 130 are welded to the side section 32 or 34 to form a vertically-disposed guide track 132, and each bar 62 has a plate 134 secured to the end of the bar 62 opposite the opening 68 for acceptance by the guide track 132 when the plate 134 is inserted edge-wise therein. A stop member 136 is welded across the upper edge of the plate 134 to prevent the plate 134 from traveling, or falling, completely through the guide track 132. Therefore, to attach each bar 62 to its corresponding side section 32 or 34, the lower edge of the plate 134 opposite the stop member 136 is directed downwardly into the guide track 132 until the stop member 136 abuts the upper edge of the track members 130, thereby halting the downward movement of the plate 134. To remove, and thereby detach, each bar 62 from the side section 32 or 34, the plate 134 is simply lifted from the corresponding guide track 132. The capacity to remove the bars 62 from the side sections 32 and 34 between uses of the apparatus 20 renders the apparatus 20 more compact and thus easier to store.

As mentioned earlier, the apparatus 20 is lifted from the floor 18 during the initial moments of a lift phase of the exercise routine and is returned to the floor 18 during a lowering phase of the routine. Consequently, the weight of the apparatus 20 (and any barbell weights 64 supported thereby) is repeatedly lifted and returned to the floor 18 during the performance of a strengthening exercise routine performed with this apparatus 20.

It is a feature of the apparatus 20 that it include means, generally indicated 74 in FIGS. 1 and 5–8, for cushioning the impact between the apparatus 20 and the floor 18 when the apparatus 20 is returned to the floor 18 during the lowering phase of the exercise routine. In the broader aspects of the invention, such cushioning means are not necessary, but in the depicted embodiment 20, the cushioning means 74 includes four spring-biased leg assemblies 76 mounted at the corners of the rectangular-shaped arrangement of the frame 30, as depicted in FIG. 2. In addition, the structure of the leg assemblies 76 is such that not only is the weight of the apparatus 20 cushioned as it is returned to the floor, but the leg assemblies 76 also cushion the transfer of the weight of the apparatus 20 to the user as the apparatus 20 is lifted from the floor 18.

Figure 8:
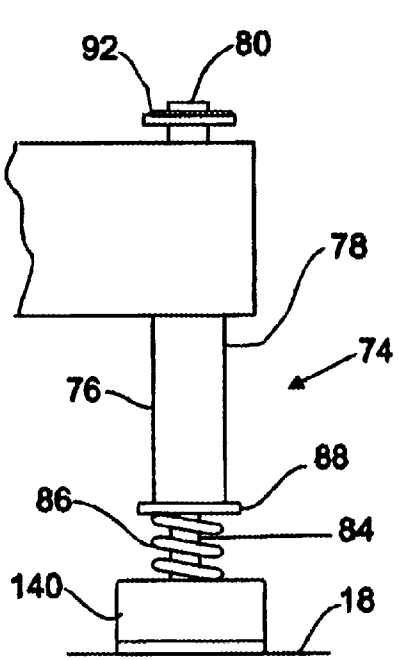
FIGS. 7 and 8 are views of the fragment of FIG. 6 shown in an assembled condition and illustrating the various positions of components of the apparatus relative to one another.
Figure 7:
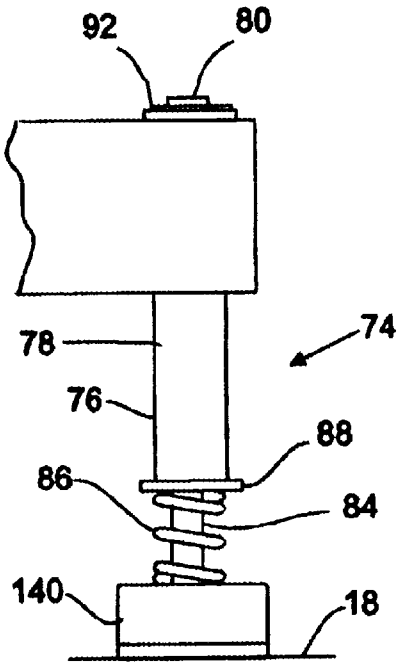
Figure 6:
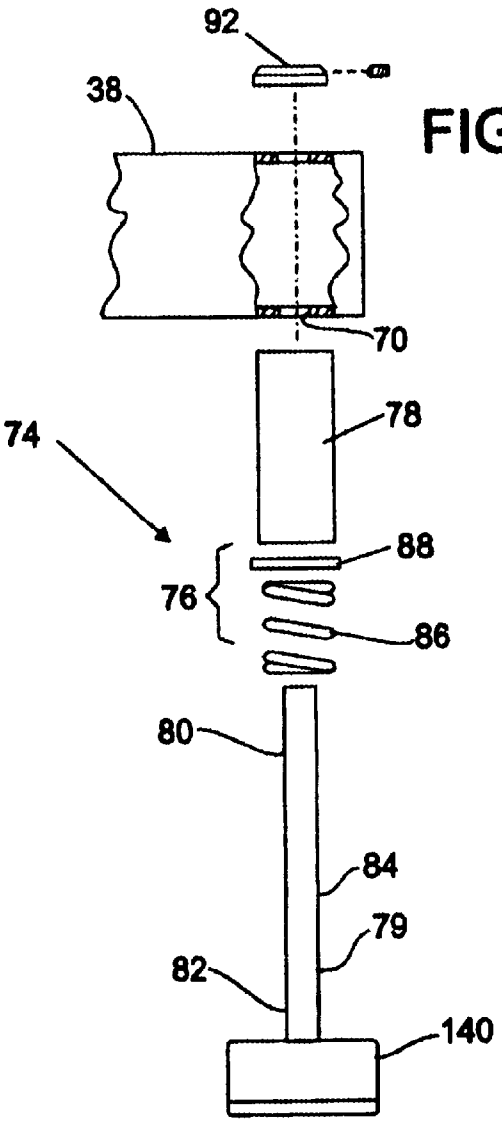
FIG. 6 is a side elevational view of another fragment of the FIG. 1 apparatus, shown exploded.

With reference to FIGS. 6–8, each side beam 38 or 40 includes a vertical through-opening 70 adjacent the front and rear beams 42, 43, and each leg assembly 76 includes a hollow sleeve-like member 78 which is positioned beneath a side beam 38 or 40 (at a corresponding corner of the frame 30) so that the through-opening of the sleeve-like member 78 is aligned with a corresponding through-opening 70. Each leg assembly 76 also includes a leg member 79 in the form of a shank 84 having upper and lower ends 80 and 82, respectively. The shank 84 is positioned within the through-opening 70 of the sleeve-like member 78 so that its upper end 80 protrudes slightly above the upper surfaces of the side beam 38 or 40. Fixedly attached to the lower end 82 of the leg member 79 is a foot assembly 140 which, as will be apparent herein, serves as a foot for engaging the floor 18 and through which the weight of the frame 30 is transferred to the floor 18. A relatively strong compression spring 86 is positioned about the shank 84 and is interposed between the lower end of the sleeve-like member 78 and the upper surface of the foot assembly 140 for acting therebetween. Preferably, a flat washer 88 having a central through-opening is positioned between the upper end of the spring 86 and beneath the sleeve-like member 78 to provide a larger surface against which the upper end of the spring 86 can act. A collar 92 is secured, as with a set screw, about the upper end 80 of the leg member 76 to secure the spring 86 and shank 84 in an assembled condition.

Within each leg assembly 76, the spring 86 continually biases the foot assembly 140 (in a downward direction) relative to the sleeve-like member 78 from a retracted condition, as illustrated in FIG. 8, to an extended condition, as illustrated in FIG. 7. During use, the spring 86 is permitted to compress to the FIG. 8 condition upon application of a sufficient downwardly-directed force to the apparatus frame 30 and when the foot assembly 140 is in engagement with the floor 18 so that the biasing force of the spring 86 is overcome. Such a compression of the springs 86 commonly occurs when the apparatus 20 is laden with a large amount of weight and is impacted foot-assembly-first against the floor 18 at the end of a lowering phase of the exercise routine.

Within the depicted apparatus 20 and as best shown in FIG. 9, each foot assembly 140 is comprised of a piece 142 of steel channel (which is suitably secured, as with welds, to the lower end 82 of the leg member 79) and a piece, or pad, 144 of rubber-like material secured beneath the underside of the channel piece 142 with screws 146. The pad 144, when constructed of rubber, reduces any likelihood that the underlying floor 18 will be damaged when contacted the foot assembly 140.

Figure 10:
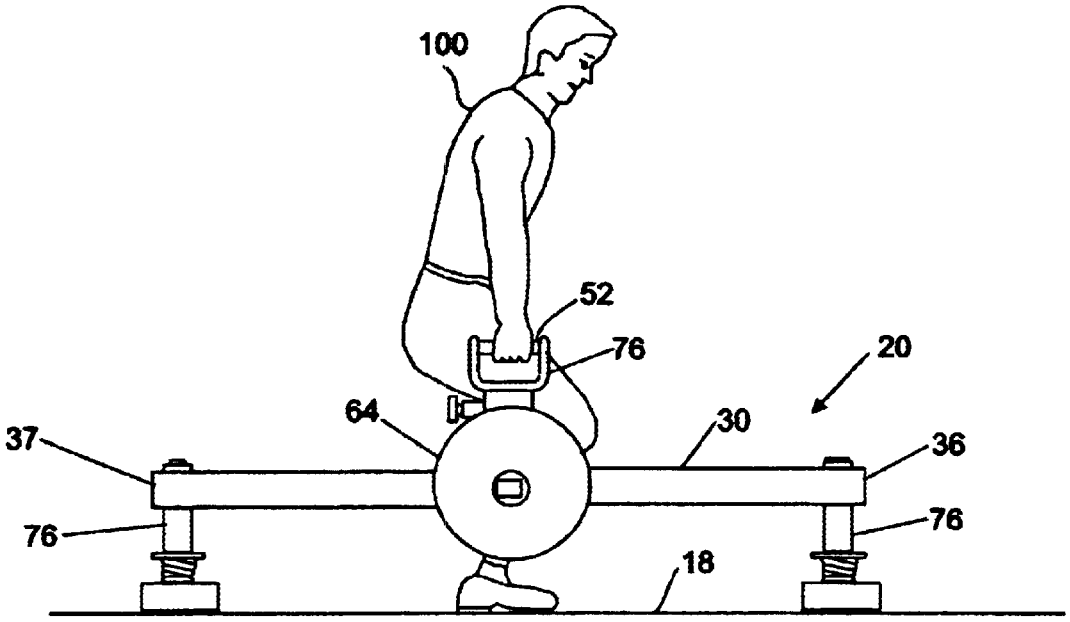
FIGS. 10 and 11 are views, as seen from the side, of the FIG. 1 apparatus being used during the performance of an exercise routine.
Figure 11:
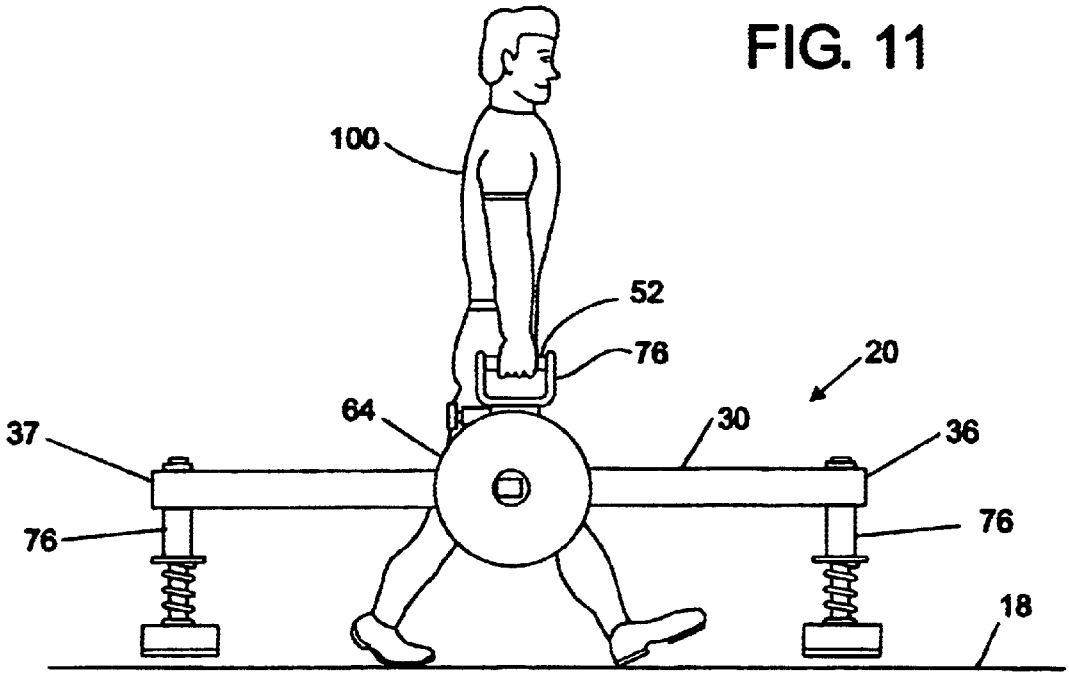

To use the apparatus 20 and with reference to FIGS. 10 and 11, a user, indicated 100, stands within the interior of the rectangular-shaped arrangement of the apparatus frame 30 so as to face forwardly thereof and grasps the grips 52 of the handle assemblies 76 with his hands. The height of the grips 52 as measured from the floor 18 is preferably selected so that when the apparatus 20 is lifted from the floor 18, the apparatus 20 clears the floor 18 by a relatively small distance, e.g. about 3 inches. This way, the user's knees need not bend too much (thereby reducing the risk of back injury) before and as the apparatus 20 is lifted from the floor 18 and thereby accommodates the lift of more weight from the floor than would be the case if the user had to lift the apparatus 20 from a deep squat position. Preferably, therefore, the user 100 should only be required to flex from a shallow, or one-quarter, squat position from a standing position (to about a three-quarter or less squat) in order to grasp the grips 52. With the hands firmly grasped about the grips 52, the user 100 stands upright and lifts the apparatus 20 from the floor 18 until his legs and back are relatively straight.

It is a feature of the apparatus 20 that it permits the user to walk while carrying the apparatus 20 so that the walking movements (i.e. stride) of the user are not impeded by the apparatus 20 or by its frame 30. Indeed, the apparatus 20 has been designed with the objective in mind that a user would be able to carry the apparatus 20 during an exercise routine and thereby benefit the muscles of the user that are required to hold the apparatus 20 (and the weight supported thereby) in a spaced relationship from the floor 18 and move, i.e. walk, while holding the apparatus 20 off of the ground, as illustrated in FIG. 11.

Moreover and with the safety aspects of the apparatus 20 in mind, the apparatus 20 has been designed so that if the apparatus 20 is dropped from its raised condition while the apparatus 20 is being carried, no part of the apparatus 20 falls upon the feet or legs of the user or the apparatus 20, itself, experiences damage. Since it is not uncommon for heavy weights to be dropped, inadvertently or otherwise, during a lift-type exercise routine when the strain of the exercise becomes too great for an individual to bear or the individual becomes too exhausted to continue, the reduced risk of injury posed to the user by the apparatus 20 if dropped is advantageous in this respect.

Along the lines of the foregoing, the interior of the frame 30 is sized so that when user stands upright and holds the apparatus 20 off of the floor 18, the walking movement of the user—in either forward or rearward directions—is unobstructed by the frame 30. In other words and while the user holds the apparatus 20 off of the ground, the user can take forward or rearward steps of appreciable length without striking the front or rear beams 42 or 43 with the shins or calves of his legs. Accordingly, the front and rear beams 42 and 43 are spaced sufficiently far apart (i.e. by a distance of at least about 40 inches) to accommodate the stride, or walking steps, of the user of at least three feet in length, and cannot strike the legs or feet of the user if the apparatus 20 is dropped from a raised position. Although an apparatus in accordance with the broader aspects of the invention can accommodate alternative stride lengths, it is preferred that such an apparatus accommodate a stride length of at least three feet.

Exemplary dimensions of the apparatus 20 are as follows: The width of the apparatus 20 as measured along the front beam 42 is about 25 inches; the spaced apart distance between the side beams 38 and 40 is about 21 inches; the length of the apparatus 20 as measured along either side beam 38 or 40 is about 50 inches; the spaced-apart distance between the front and rear beams 42 and 43 is about 44 inches; each hand grip 52 is no less than about 20 inches from the floor 18 when the apparatus 20 rest thereon, although the distance between each hand grip 52 and the floor 18 can be increased to about 28 inches; the length of each weight-supporting bar 62 is about 16 inches; each weight-supporting bar 62 is spaced about 10 inches from the floor 18 when positioned within the guide track 132; each bar 62 has a square cross section measuring 1.5 inches along each side; and each foot assembly 140 provides a floor-engaging pad having an area which measures about 3 inches by 3 inches. In addition, the compression springs 86 are sized to collectively cushion the impact of the apparatus 20 against the floor 18 during the exercise routine.

It will be understood that numerous modifications and substitutions can be had to the aforedescribed embodiment without departing from the spirit and scope of the invention. For example, although the aforedescribed embodiment 20 of FIGS. 1–11 has been shown and described as including a frame 30 of substantially rectangular shape, an apparatus in accordance with the present invention can include a frame of alternative shape, such as, for example, circular.

Furthermore, although the aforedescribed apparatus 20 has been described as including side beams 38 and 40 which are each comprised of a single unbroken beam extending between the front and rear 36 and 37 of the frame 30, the side beams 38 and 40 can possess alternative forms. For example, there is illustrated in FIG. 12 an alternative embodiment of an apparatus, generally indicated 160, having side sections 162 (only one shown in FIG. 12) comprised of a beam 164 which has been divided (i.e. cut) into two portions 164*a*, 164*b* to accommodate the positioning therebetween of a sleeve member 166 of a handle assembly 168. Whereas in the embodiment 20 of FIGS. 1–11, the side beam 38 or 40 provides an abutment surface below which the post 45 associated with the handle assembly 46 cannot extend, the sleeve member 166 slidably accepts a post 170 of the handle assembly 168 which is permitted to pass downwardly through the lower end of the sleeve member 166. Therefore, the apparatus 160 of FIG. 12 can accommodate a broader range of adjustment in the height of the hand grip of the handle assembly 46 (as measured from the underlying floor) than can be accommodated by hand grip 52 of the handle assembly 46 of the apparatus 20 of FIGS. 1–11.

Further still, although the aforedescribed apparatus 20 of FIGS. 1–11 has been shown and described as including a cushioning means 74 having a compression spring 86 which is disposed (for acting) between a sleeve-like member 78 and the foot assembly 140, the cushioning means can take an alternative form. For example, there is shown in FIG. 13 an alternative embodiment of an apparatus, generally indicated 180, having cushioning means 182 comprised of a leg assembly 184 having a compression spring 186 which is disposed (for acting) between the underside of the apparatus frame, indicated 188, and a sleeve-like member 190. Moreover, the leg assembly 184 of the apparatus 180 is secured to the frame 188 with a key 191, rather than with a collar and set screw.

Figure 14:
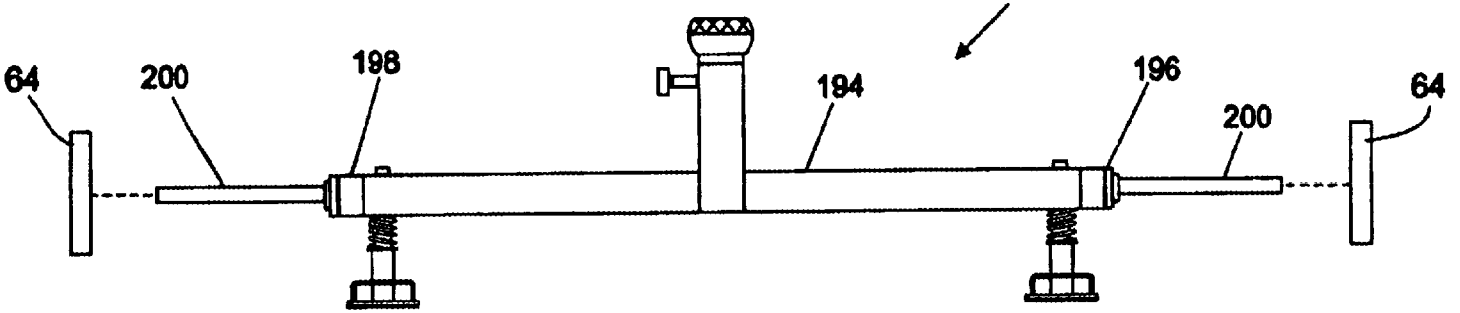
FIG. 14 is a side elevational view of still another embodiment of an apparatus within which features of the present invention are embodied.

Yet still further, although the apparatus 20 of FIGS. 1–11 has been shown and described as including weight-supporting bars 62 which are attachable to the side sections 32, 34 of the apparatus frame 30 so as to extend laterally therefrom, an apparatus in accordance with the present invention can include weight-supporting bars which are connectable to alternative locations about the apparatus frame. For example, there is illustrated in FIG. 14 an alternative embodiment, generally indicated 192, including a frame 194 having a front section 196 and a rear section 198 and further includes weight-supporting bars 200 which are connectable to the apparatus frame 194 by way of the front section 196 and the rear section 198 so that the bars 200 extend forwardly and rearwardly of the frame 194. Such a feature may be desirable (over the apparatus 20 whose bars 62 extend laterally of the apparatus frame 30) if width of the space within which the user of the apparatus desires to work out, or walk along, is limited. In either event, however, the weight of the apparatus is preferably distributed evenly between the (forward) section of the apparatus disposed forwardly of the apparatus hand grips and the (rearward) section of the apparatus disposed rearwardly of the apparatus hand grips.

Moreover, the weight-supporting bars 62 can be fixedly secured in place, as with welds, to the apparatus frame, rather than releasably secured in place, and can, in the alternative, be pivotally secured to the apparatus frame to permit the bars to be moved relative to the frame to an extended condition for use of the apparatus and a folded condition for storage.

Accordingly, the aforedescribed embodiments are intended for the purpose of illustration and not as limitation.

What is claimed is:

1. An apparatus for use during the performance of an exercise routine wherein the exercise routine includes a lift phase during which the user lifts the apparatus from the floor and a lowering phase during which the user returns the apparatus to the floor, the apparatus comprising:

a frame within which a user stands for the performance of an exercise routine and including two hand grips with which the apparatus is lifted from the floor by the user to a raised condition during the lift phase of the exercise routine and is returned to the floor during the lowering phase of the exercise routine wherein the two hand grips are disposed on opposite sides of the user from one another as the user stands within the frame; and means interposed between the hand grips and the remainder of the frame to accommodate an adjustment in the height of the hand grips from the floor before the apparatus is lifted from the floor; and the frame includes a front and a rear, is substantially rectangular in shape, and includes two opposite side beams which extend between the front and rear of the frame and two opposite front and rear beams which extend between and are joined to the opposite side beams at the front and rear of the frame to form a rigid frame which is shaped so that when the user stands within the frame for the performance of an exercise routine, the frame surrounds the user, and the distance as measured between the front and rear beams is no less than about forty inches; and wherein the frame is adapted to support barbell weights placed thereupon in preparation of the performance of an exercise routine; and wherein the frame is sized to permit the user to walk forwardly or rearwardly with the apparatus while the apparatus is held in its raised condition so that as the user holds the apparatus in its raised condition with the hand grips and takes forward or rearward steps which measure at least about three feet in length, the frame does not obstruct the walking movements of the user; and wherein the frame is shaped so that if the apparatus is dropped to the floor while the user is walking forwardly or rearwardly with the apparatus, no part of the user's feet or legs is struck by the apparatus frame.

2. The apparatus as defined in claim 1 further including bar members which are joined to the frame in a manner so that each bar member has a free end which accepts barbell weights directed over the free end thereof.

3. The apparatus as defined in claim 2 wherein the frame has means disposed on each side thereof for providing a vertically-disposed guide track and each bar member has a plate which is secured to the end of the bar member opposite the free end thereof so that each bar member is attachable to the frame by inserting the plate of the bar member edgewise into the guide track and is detachable from the frame by lifting the plate of the bar member from the guide track.

4. The apparatus as defined in claim 1 wherein the apparatus includes leg members which are connected to the frame for engaging the floor and through which the weight of the frame is transferred to the floor when the apparatus is rested thereon.

5. The apparatus as defined in claim 4 wherein the leg members are connected to the frame so that each leg member is movable relative to the frame between an extended condition and a retracted condition; and the apparatus further includes means associated with the frame for biasing the leg members from the retracted condition toward the extended condition so that when the apparatus is in a spaced relationship above the floor, the leg members are maintained in the extended condition by the biasing means and so that when the apparatus is lowered to the floor during the lowering phase of the exercise routine, the leg members engage the floor and are permitted to move relative to the frame toward the retracted position under the weight of the frame and in opposition to the force of the biasing means to thereby cushion the impact of the apparatus against the floor.

6. The apparatus as defined in claim 5 wherein each leg member includes a broad floor-engaging pad whose smallest dimension as measured across the pad is at least about three inches.

7. The apparatus as defined in claim 1 wherein the hand grips are disposed at no less than about twenty inches from the floor before the apparatus is lifted from the floor.

8. The apparatus as defined in claim 1 wherein the two hand grips are rigidly connected to one another through the frame so that the spaced distance between the two hand grips remains constant.

9. The apparatus as defined in claim 1 wherein the apparatus frame includes a front section disposed forwardly of the hand grips and a rear section disposed rearwardly of the hand grips, and the weight of the frame is distributed between the front and rear sections so that the weight of the front section is about equal to the weight of the rear section.

10. An apparatus for use during the performance of an exercise routine involving a lift phase during which the user lifts the apparatus from the floor and a lowering phase during which the user returns the apparatus to the floor, the apparatus comprising:

a frame within which a user stands for the performance of an exercise routine wherein the frame has a front and a rear and is shaped so as to surround the user when the user stands within the frame as aforesaid, the frame includes two opposite side beams which extend between the front and rear of the frame and two opposite front and rear beams which extend between and are joined to the opposite side beams at the front and rear of the frame to form a rigid frame of rectangular shape, and the distance as measured between the front and rear beams is no less than about forty inches;

hand grip assemblies including a pair of hand grips which are joined to the frame so as to be disposed on opposite sides of the user when the user stands within the frame and which are adapted to be grasped by the hands of a user and lifted from the floor to a raised condition during the lift phase of the exercise routine and returned to the floor during the lowering phase of the exercise routine; and means interposed between the hand grips and the remainder of the frame to accommodate an adjustment in the height of the hand grips from the floor before the apparatus is lifted from the floor; and wherein the frame is adapted to accept barbell weights placed thereon for increasing the total weight supported by the frame in preparation of an exercise routine and the frame is sized to permit the user to walk forwardly or rearwardly with the apparatus while the apparatus is held in a raised condition so that as a user holds the apparatus in a raised condition with the hand grips and takes forward or rearward steps which measure at least about three feet in length, the frame does not obstruct the walking movement of the user; and wherein the frame is shaped so that if the apparatus is dropped to the floor while the user is walking forwardly or rearwardly with the apparatus, no part of the apparatus frame strikes the user's feet or legs.

11. The apparatus as defined in claim 10 further including bar members which are joined to the frame in a manner so that each bar member has a free end which accepts barbell weights directed over the free end thereof.

12. The apparatus as defined in claim 11 wherein the frame has means disposed on each side thereof for providing a vertically-disposed guide track and each bar member has a plate which is secured to the end of the bar member opposite the free end thereof so that each bar member is attachable to the frame by inserting the plate of the bar member edgewise into the guide track and is detachable from the frame by lifting the plate of the bar member from the guide track.

13. The apparatus as defined in claim 10 wherein each hand grip is attached to a downwardly-depending post, and the frame includes a pair of upwardly-opening sleeves adapted to slidably accept the downwardly-depending post attached to a corresponding hand grip, and the adjustment means includes means for releasably securing the post to the sleeves at alternative positions along the length thereof to thereby accommodate an adjustment in the height of the hand grips from the floor before the apparatus is lifted from the floor.

* * * * *